US005516230A

United States Patent [19]

Bargeron et al.

[11] Patent Number: 5,516,230

[45] Date of Patent: May 14, 1996

[54] GATE FOR CONTROLLING UPSTREAM WATER LEVEL

[76] Inventors: Richard J. Bargeron, Rand Rd., Shelburne Falls, Mass. 01370; Robert G. Bartlett, 83 River Rd., Leyden, Mass. 01337

[21] Appl. No.: 238,382

[22] Filed: May 5, 1994

[51] Int. Cl.[6] ..... E02B 7/42

[52] U.S. Cl. ..... 405/100; 405/92; 405/99

[58] Field of Search ..... 405/92–103

[56] References Cited

U.S. PATENT DOCUMENTS

| | | | |
|---|---|---|---|
| 843,959 | 2/1907 | McBride | 405/92 X |
| 2,207,479 | 7/1940 | Danel | 405/94 |
| 2,667,748 | 2/1954 | Heath | 405/92 |
| 2,699,652 | 1/1955 | Lazlo . | |
| 2,699,653 | 1/1955 | Ponsar . | |
| 3,643,443 | 2/1972 | Alexandre . | |
| 3,683,630 | 8/1972 | Alexandre . | |
| 3,695,043 | 10/1972 | Vallet . | |
| 3,739,585 | 6/1973 | Dubouchet | 405/100 X |
| 4,027,487 | 6/1977 | Alexandre . | |
| 4,449,851 | 5/1984 | Combes et al. | 405/100 X |
| 4,576,512 | 3/1986 | Combes | 405/100 |
| 4,606,672 | 8/1986 | LeSire | 405/92 X |
| 4,797,027 | 1/1989 | Combes et al. | 405/92 |
| 4,877,352 | 10/1989 | Tuttle et al. | 405/104 |
| 4,963,057 | 10/1990 | Fournier | 405/93 |

*Primary Examiner*—Dennis L. Taylor

[57] ABSTRACT

A self-actuating water control gate comprised of a stepped radial gate face 14 mounted on hinge arms 19 extending downstream to a pivot shaft 12 and to a counterweight 11 and support system. The gate face 10 includes a hydraulic thrust surface 15, and radially shaped end plates 17. The gate face has an upper section 14 and lower section 16 whose radii differ by predetermined amount. The support system for the counterweight 11 includes a pattern of holes 26 and eccentric cams 27 providing for adjustable sensitivity. The radial endplates 17 in combination with matching fixed jambs provide a small constant clearance in operation, confining the flow to the area below the gate. A fixed viscous damping vane 33 extends from the front of the gate into the approaching flow. The vane has an irregularly castellated vortex dispersing leading edge.

18 Claims, 5 Drawing Sheets

GATE FOR CONTROLLING UPSTREAM WATER LEVEL

Automatic gate for controlling upstream water level.

BACKGROUND - FIELD OF INVENTION

This invention relates to automatic devices for control of the level of water flowing at varying rates in a channel or canal, specifically to devices repairing no outside power sources.

BACKGROUND - PRIOR ART

There are dozens, perhaps hundreds, of water flow situations where it is desired to maintain the upstream level as nearly constant as practical. Large-scale examples include recreational ponds, inland waterways, and powerdam forebays.

On a smaller scale are unit processes in water and wastewater treatment plants. While flow varies greatly over a twenty-four hour period it is nevertheless desirable to hold water levels reasonably constant if possible. In primary settling tanks of many wastewater treatment plants the outflow enters an open channel leading to the next process. The channels are sized for the highest flows expected so most of the time they run only partially full. Because the water enters the channel by spilling over the top edge, this means the water falls into a nearly empty channel at many times of the day. At this early stage of the treatment process the water still contains volatile organic compounds and malodorous gasses which are released to the atmosphere by the impact. It is desirable to reduce the spill distance by maintaining the level in the channel just below the top so the gas release is minimized.

Many schemes have been employed to control water level. Some use complex computer-controlled sensor driven motorized valves and gates. Control can be very accurate but comes at high initial cost, and high operating cost. Frequent adjustment, high maintenance and energy costs, and regular replacement of worn out components characterize these complex systems.

Simple devices are available requiring no outside power sources. An example is the weighted flap gate, hinged along the top, which responds to water pressure tending to push it open (U.S. Pat. No. 4,606,672 to LeSire, 1986). As the gate opens, the counterweight travels an arc, decreasing its influence. Upstream level is backed up at first, then allowed to drop somewhat as flow increases. To control level as flow increases, flap gates of this kind require a precise fit along the swept sides to preserve level at low flows. This requires either highly accurate installation work or a matched external framework to limit side clearance. The sweeping motion at the sides is susceptible to fouling from material caught in the clearance. For a given size and position of counterweight the flow range and/or head difference upstream-to-downstream is limited.

Another simple device is the Amil oscillating float type, using variable opposing couple to regulate level. These products have two ballast tanks (counterweights) and have an integral float tank on the upstream face. The control function depends heavily on the watertightness of the float. The device is intended to balance when the approaching water level is at the level of the pivot.

The Amil gate requires a straight section of close-fitting accurately matched channel for consistent side-clearance for the gate face and rear ballast tank. Some require this piece to have a trapezoidal cross-section. Whether supplied by the gate manufacturer or built in place by the installer this matching channel section is a required element for proper function. Installation in existing channels can require extensive modifications and process downtime.

The Amil type unit has no specific provisions for adjustment of control level. To overcome the limitation of fixed control level some designs use ports or vents or partial filling of the front float tank (ex. U.S. Pat. No. 4,027,487 to Alexandre, 1977). Another variation employs a complex fixture which positions the whole assembly higher or lower by means of a sliding mount (U.S. Pat. No. 4,877,352 to Tuttle, Deshaw, 1989).

Initial field setup of Amil units is cumbersome, requiring an empty channel for the first steps but full water level for the rest. Moreover the full water condition must be at near zero flow because the gate must be closed but the level held constant. This process is difficult and time-consuming at best.

The float on the Amil unit is an integral part of its operation. Should the float chamber leak and partially fill with water, the gate will not perform as desired.

The float on the Amil unit presents another shortcoming. In some instances a channel may become flooded when the downstream portion is unable to carry away the flow. Under these conditions, the float will cause the gate to rise to the flooded water level. When the water level eventually decreases, the float will ride the surface, failing to preserve upstream level.

The manufacturers of both weighted-flap and Amil type gates refer to them as "constant upstream level gates". Actually, neither holds upstream level exactly constant. What really happens is that while flow varies the gate opens or closes holding upstream level within a range of a few inches, giving the appearance of being relatively constant. The sensitivity of the gate is the narrowness of this range, the higher the sensitivity the narrower the range.

The sensitivity of Amil gates is high and is presumably fixed. Balance is delicate with high sensitivity, making upsets and sticking more likely. If sensitivity were adjustable the performance best suited to actual installation conditions could be obtained.

Shock absorbers are sometimes installed to counteract the effects of high sensitivity, but this produces hysteresis errors in control level. The shock absorbers change characteristics with temperature and are subject to wear so must be regularly inspected and maintained. Worn-out shock absorbers allow gates to slam violently, leading to broken welds, bent gate arms, and disruption of the hydraulics of the application.

SUMMARY OF PRIOR ART

While the weighted flap gate and the Amil type oscillating gate are simpler and cheaper than powered systems, several problems remain. Both require costly channel adapters and have narrow performance range. The Amil has limited adjustment of control level and none for sensitivity. Initial calibration is inconvenient. Float chambers can develop leaks and shock absorbers wear out, raising questions of reliability. Floating gates cannot resume their control function quickly when recovering from a flooded-channel condition.

OBJECTS AND ADVANTAGES

The present invention is a level-controlling gate with a non-buoyant hydraulic thrust surface and single counterweight mounted so as to provide adjustable control level and adjustable sensitivity.

The unit is simple, requiring no motors, manual intervention or external power source. It has a single moving part and is driven completely by gravity and the water flowing under it.

At each channel wall the gate face has a flat endplate with curved front edge which is radial with the gate pivot. In operation, swing clearance is held to a small constant gap by a curved jamb strip attached to the channel wall. This feature eliminates the need for a precisely-matched external frame, allowing installation in out-of-square channels or flumes. Another advantage of the radial jamb is high resistance to fouling from foreign material in the clearance. The back edge of each endplate is also curved. In the event of ice buildup near the gate this endplate geometry reduces the possibility of seizure.

As received at the installation site the unit is complete and ready to operate without need of any initial adjustments. Sensitivity and control level are preset for the application before shipment. This is made possible by two factors. The first is an accurate computer model developed to numerically predict the performance of the gate. The other is a system of check shapes and reference points in the physical parts of the gate which insure that as manufactured the gate precisely agrees with the computer model.

Should field conditions change or the user desire different operating characteristics, the unit is provided with convenient adjustments for sensitivity and control level. Sensitivity can be increased or decreased by adjustment of counterweight position. Control level can be shifted up or down (without changing sensitivity) by adjustment of cams on the counterweight supports or risers.

Installation is accomplished by simply placing the unit in the flow channel, sliding the bearing mounts out against the channel walls and bolting in place. It is not necessary to have water flow available nor is it necessary to drain the channel completely for installation. The counterweight is mounted above and slightly behind the pivot point and is narrower than the channel. This geometry allows installation in curved channels (common in wastewater plants) without need of a straight section for counterweight clearance. Initial adjustment range and calibration are built-in at manufacture, thus no field filling of ballast tanks is needed. Once installed it requires minimal maintenance (occasional greasing of the pivot).

Rather than using a float tank, the unit has a hydraulic thrust surface on the face which creates the needed opening force. The upforce is reliable since there is no tank to leak. Because the surface produces no net buoyant upforce unless the water is moving, the gate drifts closed under flood conditions, preserving upstream level. Manufacture of the gate face is simpler and the face becomes inherently rigid due to its shape.

Because gates of this type can be upset by wave action, other designs use conventional automotive-type shock absorbers to limit unwanted oscillations. These motions are damped in the present unit by a submerged fixed vane or viscous damping surface extending into the approaching flow. This damping surface has no wearing parts and is shaped to function without compromising sensitivity, control level, or flow capacity of the gate.

Further objects and advantages of the level-controlling gate will become apparent from a consideration of the drawings and ensuing description.

REFERENCE NUMERALS IN DRAWINGS

10 Gate Face
11 Counterweight
12 Pivot Shaft
13 Channel
14 Upper Gate Face
15 Hydraulic Thrust Surface
16 Lower Gate Face
17 End Plates
18 Ribs
19 Arms
20 Rib-ArmAlignment Edges
21 Rib-ArmAlignment Holes
22 Alignment Surfaces on the Endplates
23 Alignment Surfaces on the Ribs
24 Risers
25 Flush-fit Common Corner
26 Counterweight Adjustment Pattern
27 Counterweight Angle Adjustment Cam
28 Cam Guide Bars
30 Arm Spacer
31 Bearings
32 Pivot Supports
33 Viscous Damping Surface
34 Irregularly Castellated Edge
35 Radial Jambs
36 Channel Bottom
37 Channel Flow
38 Upstream Water Level
39 Channel Walls

DESCRIPTION OF INVENTION

Figure 1:
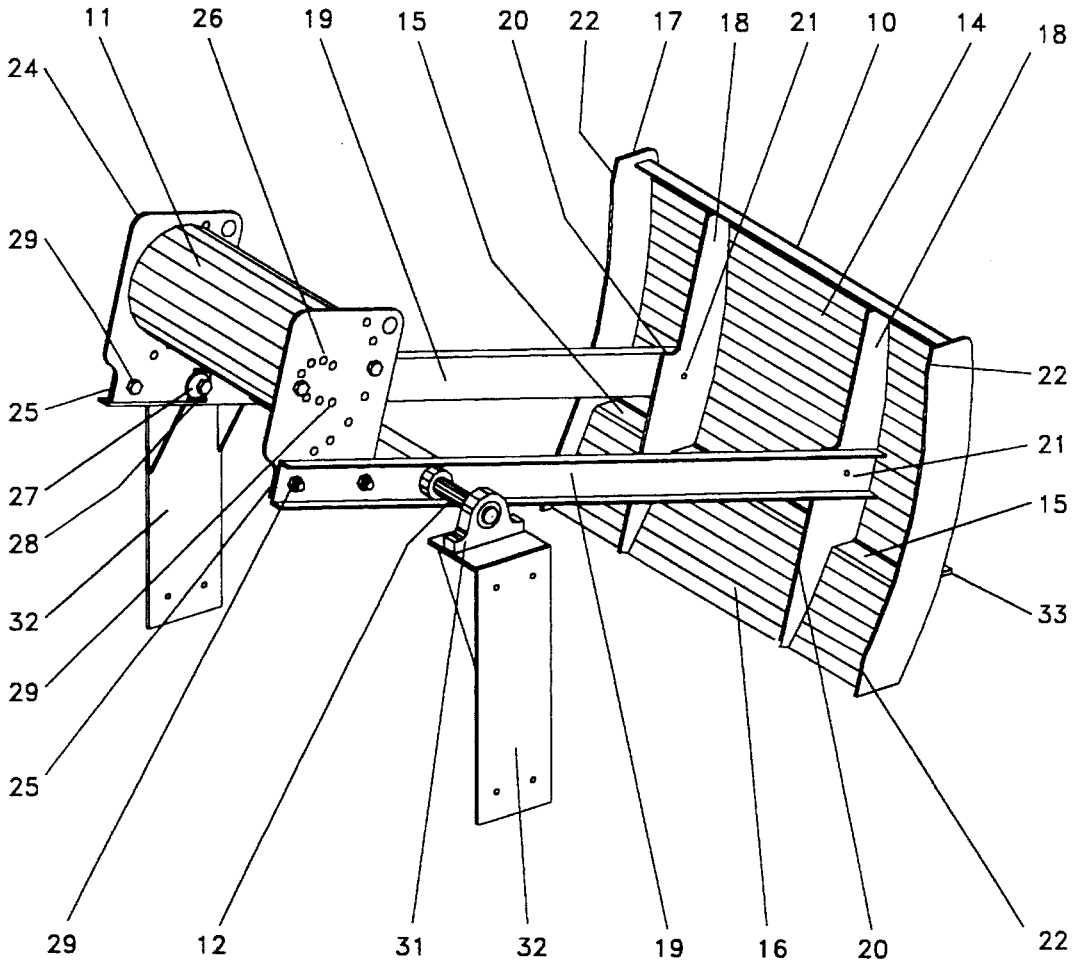
FIG. 1 shows the preferred embodiment of the level-controlling gate before it is installed. The view is from above and slightly downstream of the gate.

The level-controlling gate is essentially a gate face 10 and counterweight 11 that pivot or rotate about a pivot shaft 12. FIG. 1 shows a view from above and slightly downstream of the preferred embodiment, without the channel 13 shown. The gate face 10 is comprised of an upper face 14, a hydraulic thrust surface 15, and a lower face 16. The upper face 14 and lower face 16 are each arcs with centers of curvature at the pivot shaft 12. The radius of the lower face 16 is less than the radius of the upper face 14, and the offset between these two face sections forms the hydraulic thrust surface 15.

All aspects of the gate are symmetrical about the center line of the water channel 13. The edges of the gate face 10 are stiffened with two endplates 17. On the rear of the gate face 10, two or more ribs 18 are affixed, for additional stiffening. Two of the ribs 18 are connected to the two arms 19, which extend rearward from the gate face 10. The ribs and arms have alignment holes 20 and alignment edges 21. There are alignment surfaces on the endplates 22 and corresponding alignment surfaces on the ribs 23.

At the other end of the arms 19 are connected the two counterweight supports or risers 24. The risers 24 and arms 19 share a flush-fit common corner 25. The risers 24 hold the counterweight 11 in a position determined by the counterweight adjustment patterns 26 and the counterweight angle adjustment cams 27 and cam guide bars 28.

The counterweight 11 is fastened to each riser 24 by two bolts, through two of the holes in the counterweight adjustment pattern 26. The counterweight angle adjustment cams 27 are each formed of a bolt with its head rigidly fixed to an eccentric disk. As the cams are turned, the risers 24 pivot about the rearmost bolt in each arm 19.

Between the face end and the counterweight end of the arms 19, the arm spacer 30 bridges across the two arms, keeping them parallel. Through the arm spacer 30, and affixed to the arms 19, runs the pivot shaft 12. The pivot shaft 12 extends past the arms 19 on each side, and a spherical bearing 31 is mounted near each end of the pivot shaft 12. The bearings 31 are affixed to the pivot supports 32, which are brackets extending downward.

Figure 2:
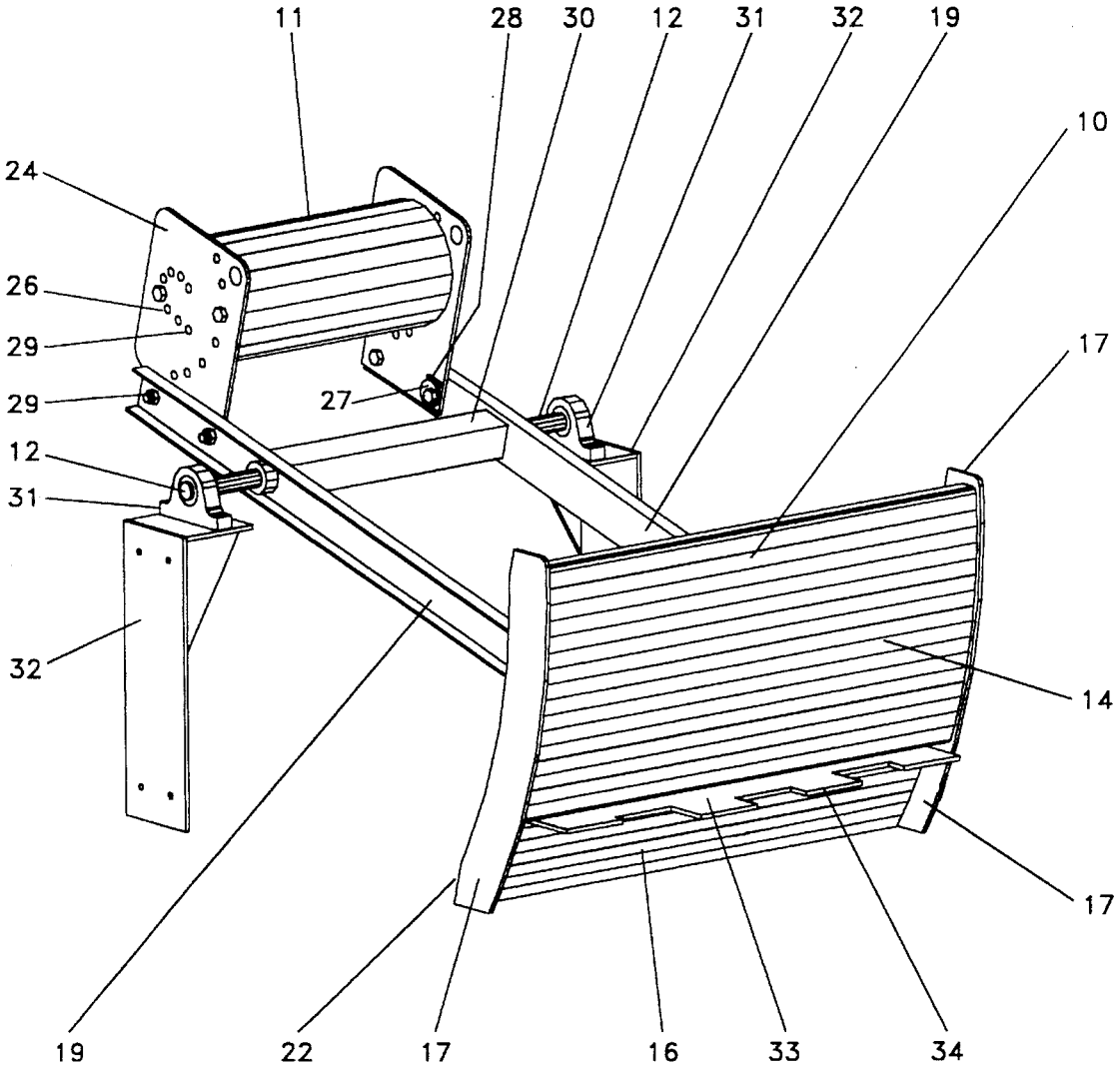
FIG. 2 shows an upstream view before installation.

The viscous damping surface or vane 33 is affixed to the hydraulic thrust surface 15, on the front of the gate face 10, as shown in FIG. 2. The irregularly castellated edge 34 of the damping surface 33 is shown in this view.

Figure 3:
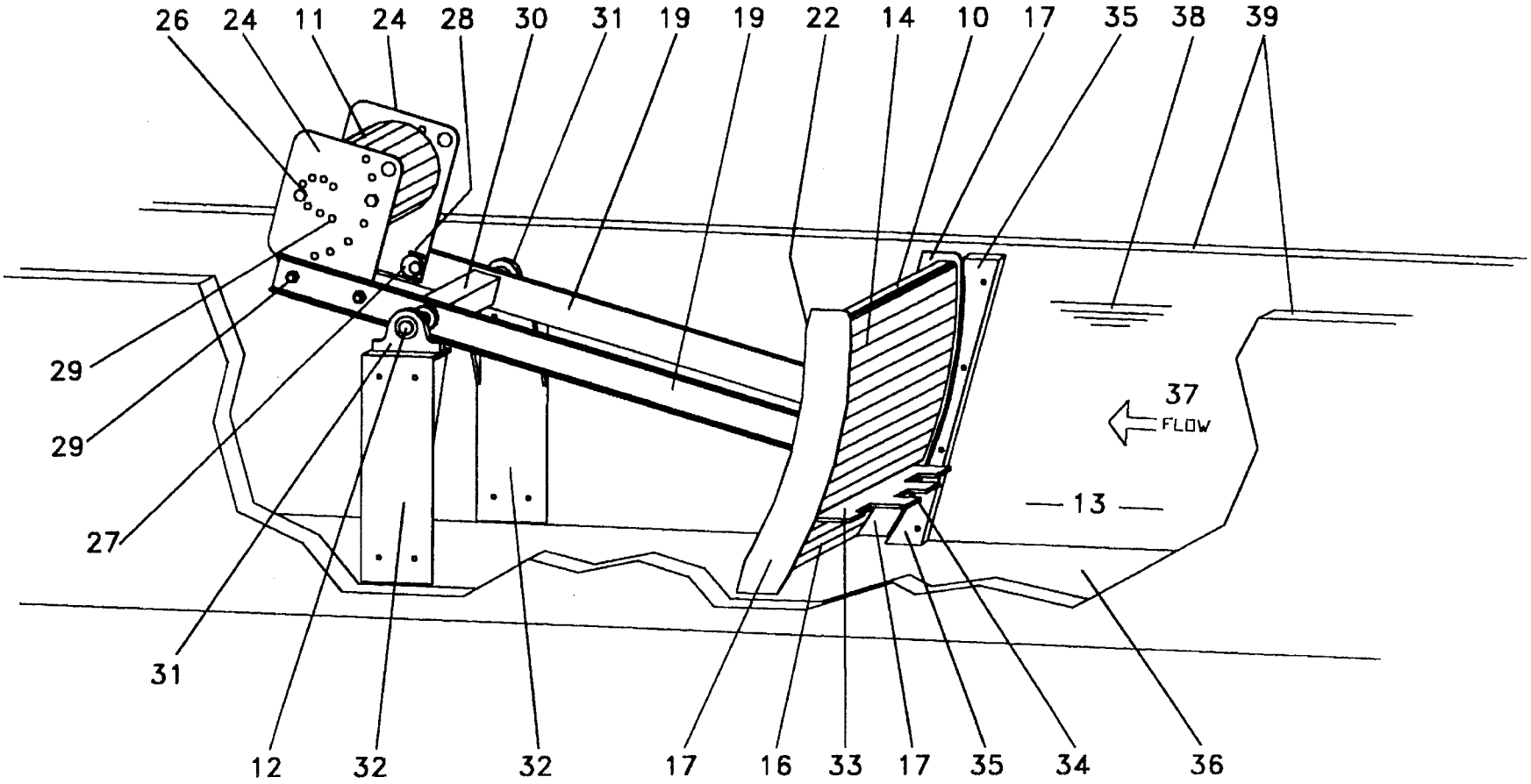
FIG. 3 shows a side view of the installed gate, in the closed position with the channel wall cut away for clarity.

FIG. 3 shows the arrangement of the endplates 17 and the radial jambs 35 (near side jamb not shown). The radial jambs 35 are formed to match the front radial edge of the endplates 17.

OPERATION OF THE INVENTION

Figure 4:
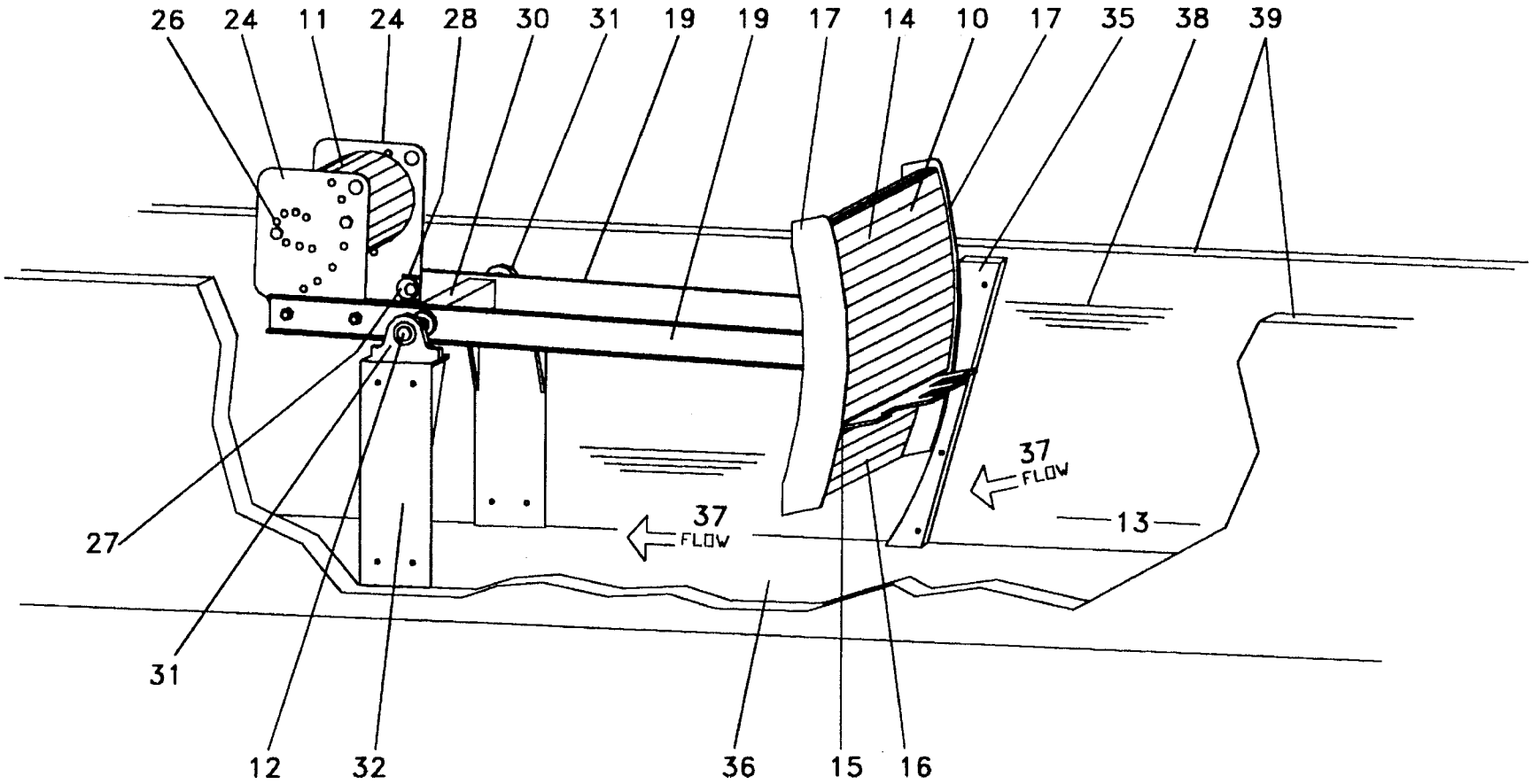
FIG. 4 is similar to FIG. 3 except the gate is partly open. In both FIG. 3 and FIG. 4, the nearer radial jamb 35 is not shown, for clarity.

The level-controlling gate operates due to the forces of gravity, and the forces of the water flowing through the gate. This is best seen in FIG. 4. The gravity and hydraulic forces create torques about the pivot shaft 12 of the gate. The gate shaft is free to pivot due to bearings 31. Since there is no outside source of power, these torques are the only source of motion of the gate. These torques must sum to zero whenever the gate is not in motion. Exceptions to this rule are when the gate is resting closed against the channel bottom 36, or open against a mechanical stop (not shown).

Steady-State Operation

When the channel flow 37 is constant and there are no waves in the channel 13, the gate settles into a steady-state condition, and will only move if the channel flow 37 or upstream water level 38 changes. This situation is shown in FIG. 4. The torques due to the weight of the gate face 10, arms 19, endplates 17, ribs 18, risers 24, viscous damping surface 33, and counterweight 11 are precisely offset by the hydraulic torques. The rotation of the gate is constrained between the channel bottom 36 and the mechanical stop (not shown).

The hydraulic forces against the upper gate face 14, the lower gate face 16, and the hydraulic thrust surface 15 can be analyzed as torques about the pivot shaft 12. This hydraulic torque is a function of the upstream water level 38 and the amount of gate opening. As the water level 38 increases, the hydraulic torque increases, if the gate is still. As the gate rotates open, the thrust torque decreases if the upstream water level 38 doesn't change. These two effects interact. If the upstream water level 38 rises, the gate starts to pivot open due to increased hydraulic torque. If the gate has pivoted opened too far, it starts to close, due to decreased hydraulic torque.

Design

In level-controlling gate applications there are two conditions to be satisfied in order for the gate to perform properly (see FIG. 4). The first condition is the maximum level allowed at the maximum specified channel flow 37. The second condition is the minimum water level to be maintained at essentially zero channel flow 37. Both of these conditions are met through design of the gate prior to manufacture. Knowing the desired maximum and minimum upstream water levels 38, the torques described in the "Operation of the Invention" section above are incorporated into a parametric computer model of the gate. This model is used to adjust the gate design parameters until the torques can be shown to sum to zero at each gate position.

Dynamic Operation

When a surface wave or change in flow occurs in the channel, an upset of the steady-state condition occurs, which can cause oscillatory motion of the gate. The viscous damping surface 33 (see FIGS. 2, 3, 4 and 6) reduces this oscillatory motion. It operates by adding drag torque whenever the gate is in motion. The drag torque is always opposite to the torque imbalance that caused the motion in the first place. This causes the angular acceleration to be reduced. The damping surface 33 creates no drag torque when the gate is still. The leading (upstream) edge is irregularly castellated 34 to reduce the effect of vortex formation on the operation of the gate.

Adjustment

Figure 5:
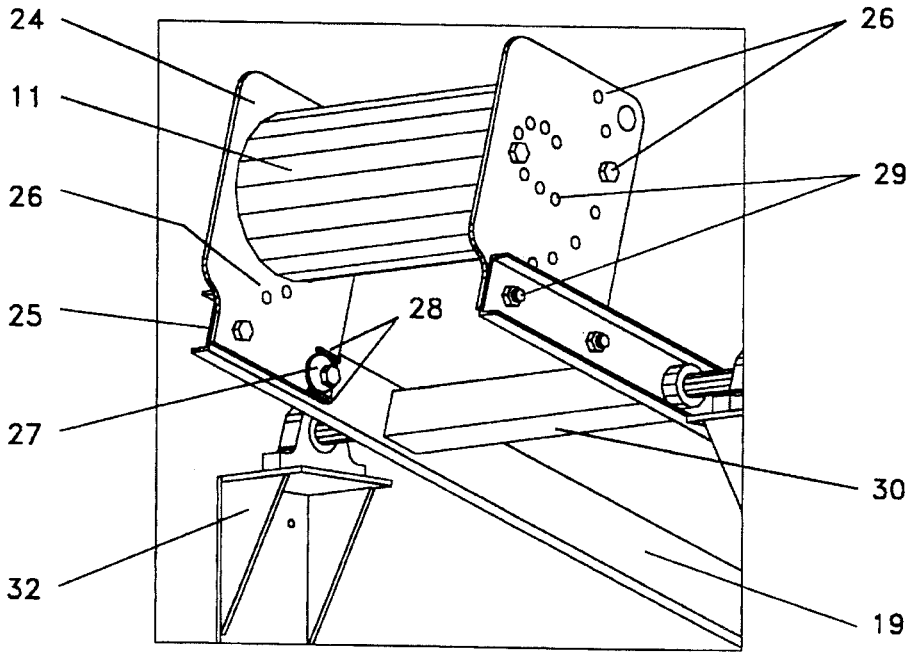
FIG. 5 is a closer view of the counterweight angle adjustment cam 27 and cam sliders 28.
Figure 6:
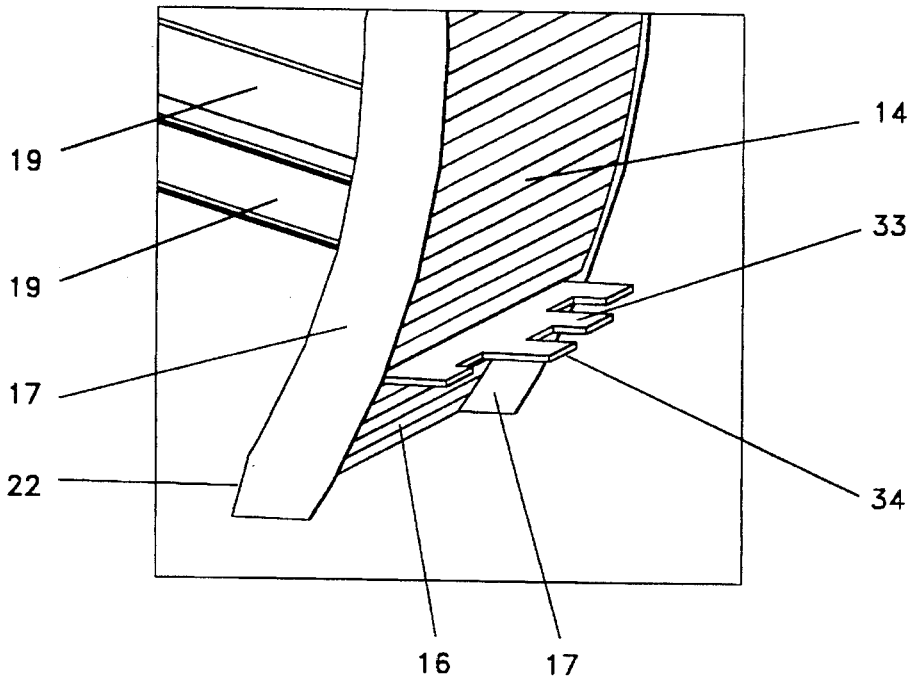
FIG. 6 is a closer view of the irregularly castellated edge 34.

Several field changes can be made to the gate in the event adjustment is desired. These adjustment features are shown in all Figures except 6, while FIG. 5 is a closer view of the counterweight angle adjusting cam 27 and cam guide bars 28. The counterweight angle cam 27 is rotated with a wrench and the cam pushes on the guide bars 28 to change the angle of the risers with respect to the arms 19. Changing the counterweight angle in this manner effects both the minimum and the maximum upstream water levels 38. Changing the counterweight position using the counterweight adjustment pattern 26 effects only the minimum upstream water level 38. The amount of either or both adjustment needed for a specific change in performance can be determined with the aid of the computer model. Alternatively, a trial-and-error process can be used. Other methods of adjustment or provisions for adjustment will become obvious upon further study of the invention.

Installation

The gate is easily installed into the channel 13 formed by the channel walls 39 and the channel bottom 36. This process can best be followed by examining FIG. 3. The entire unit is lowered into the channel with a conventional lifting device or crane (not shown). The pivot supports 32 are slid out against the channel walls 39, and the entire unit is positioned so that the gate face 10 is perpendicular to the channel walls 39, and the endplates 17 do not rub on the channel walls 39.

The pivot supports 32 ensure proper pivot shaft 12 height when they are resting on the channel bottom 36. The pivot shaft 12 is free to slide laterally in the bearings 31, simplifying the alignment of the gate face. Mounting holes are provided in the pivot supports 32, and holes are then drilled into the channel walls 39 using the mounting holes. Appropriate bolts or anchors (not shown) are used to rigidly affix the pivot supports 32 to the channel walls 39.

The radial jambs 35 are then anchored to the channel walls 39 in a manner similar to that used for the pivot supports 32. To ensure proper operation of the level controlling gate, the clearance between the endplates 17 and the radial jambs 35 is kept to a minimum constant distance. This is accomplished by placing a thin shim between the endplate 17 and radial jamb 35. before bolting the radial jamb in place. With the shim removed the gate is free to pivot up and down in the channel 13, and side leakage is held to a minimum due to the constant clearance between the endplates 17 and the radial jambs 35.

Notice that the gate may be installed into existing channels that were not designed for this gate. No channel 13 modifications are needed, beyond drilling a few anchor holes into the channel walls 39. The channel bottom 36 is left unobstructed after installation, so silting of the channel bottom 36 will not occur. Note also that no calibration or initial adjustment is needed after installation. Thus, it is not necessary to be able to maintain a certain flow or a certain level of water in the channel for this gate to be put into operational condition.

Fabrication

For the actual production level controlling gate to match the theoretical performance predicted by the computer model, a reasonable degree of manufacturing precision is needed. To this end the component parts are designed with built-in reference points and alignment aids which facilitate the production process. These features are best seen in FIG. 1.

The risers 24 are shaped to provide a flush-fit common corner 25 with the arms 19. The ribs 18 have rib-arm alignment holes 20 and rib-arm alignment edges 21 which match corresponding points on the arms 19. The alignment surfaces 22 on the endplates 17 are straight surfaces which all lie in the same plane as the alignment surfaces 23 on the ribs 18 to facilitate flat-table positioning for welding. The front edges of the ribs 18 are cut to the exact contour of the rear of the gate face 10. This allows small curvature errors in the gate face 10 to be clamped out against the ribs 18 during manufacture. Shop-verification of proper balance is made possible by check holes for assembling the counterweight 11 and risers 18 in a "static balance" check position.

Summary

The reader can see that the disclosed level-controlling gate can be used to control the upstream water level 38 in a channel 13 within prescribed limits, over a wide range of flows. The gate is easily designed, fabricated, and installed in an unmodified channel 13. Furthermore, if field adjustments are needed, they may be accomplished with a wrench. The design does not constrain the pivot shaft 12 to be at or near the desired upstream water level 38 as other designs do. Although similar gate designs are of the oscillating type, the disclosed gate is inherently stable under static hydraulic conditions (no waves in channel, steady flow). The viscous damping surface 33 reduces the gate's response to sudden hydraulic changes, but allows it to quickly settle to a new equilibrium position. The hydraulic thrust surface 15 is of a non-floating design, allowing the gate to quickly resume level-controlling operation should the channel 13 be flooded due to external events.

Ramifications and Scope

While the above description contains many specificities, these should not be construed as limitations on the scope of the invention, but rather as an exemplification of one preferred embodiment thereof. Many other variations are possible.

For example, the hydraulic thrust surface 15 does not need to be horizontal when the gate is closed. With minor changes to the design equations, the upper 14 and lower gate faces 16 do not need to be radial to the pivot shaft 12, and in fact could be flat plates.

If it was desired to have the gate remain open under flooded conditions, buoyant material could be placed on the back side of the gate face 10. The single counterweight 11 could be replaced by two or more equivalent weights to allow further adjustment.

The adjusting mechanisms 26 and 27 could be differently fabricated. Other adjustments, such as the ability to add weight to the gate face 10, could be added. Shock absorbers could replace the viscous damping surface 33. The viscous damping surface 33 can be connected to the gate face at a point other than the hydraulic thrust surface 15.

The cross-section of the channel 13 need not be rectangular. A bottom seal could be added to the bottom of the lower gate face 16 if reduced leakage was needed when the gate was closed.

The gate members can be made from metal, fiberglass, or other rigid structural materials. The solid counterweight 11 could be replaced by a chamber that is filled to achieve the desired mass. Other methods, such as adhesives, could be used to mount the pivot supports 32 and radial jambs 35 onto the channel walls 39.

The features that simplify fabrication and ensure proper construction are not necessary for proper function of the gate, if other proper care is taken in assembly. The level of a fluid other than water may also be controlled with this gate.

Accordingly, the scope of the invention should be determined not by the embodiments illustrated, but by the appended claims and their legal equivalents.

We claim:

1. For controlling flow-induced level changes in the upstream reach of a channel with a flowing fluid, a level-controlling gate, comprising:

(a) a face for controlling said flowing fluid, said face incorporating an upper gate face section which forms an arc with a center of curvature at a pivot axis, and with a predetermined radius, and a lower gate face section which forms an arc with a center of curvature at said pivot axis, and with a radius that is a predetermined amount less than said radius of said upper gate face section, (b) said face incorporating a hydraulic thrust surface connecting the lower edge of said upper gate face section to the upper edge of said lower gate face section, said hydraulic thrust surface providing a variable opening torque about said pivot axis, (c) a counterweight system, comprising one or more masses mounted to provide a variable closing torque about said pivot axis, and (d) members for rigidly connecting said face to said counterweight system and also to a horizontal pivot shaft mounted coaxially to said pivot axis, downstream from said face, across said channel, in such a manner that said face will pivot in said channel, to a position in which said variable opening torque and said variable opening closing torque are in balance, whereby said flowing fluid passes through the opening below said face, and whereby, in the .presence of said flow-induced level changes, said face will be driven more open or closed by said combination of said variable opening torque and said variable closing torque, such that said flow-induced level changes are mitigated, and whereby said opening torque produced by said hydraulic thrust surface is zero when said fluid is not flowing.

2. The level controlling gate of claim 1 further including (a) endplates connected to said face, said endplates having radially shaped edges coaxial with said pivot axis, and (b) radial jambs mounted on walls of said channel concentric with said end plates and whose radius is a predetermined amount greater than the radius of said endplates, whereby said radially shaped edges of said endplates substantially match said radial jambs, minimizing flow between said endplates and said radial jambs and substantially confining said flowing fluid to said opening below said face.

3. The level controlling gate of claim 1 further including a viscous damping surface extending into said flowing fluid from said gate face.

4. The level controlling gate of claim 3 further including an irregularly castellated edge on said viscous damping surface, whereby the effects of vortex formation on the operation of said gate are made smaller and more random.

5. The level controlling gate of claim 1 further including slidable mounting of said pivot shaft and bearings, whereby said gate can be installed in straight or curved channels.

6. The level controlling gate of claim 1 further including adjustments for position of said counterweight system.

7. The level controlling gate of claim 1 wherein said hydraulic thrust surface extends the entire width of said gate face.

8. For installation in a channel with a flowing fluid, a hydraulic gate, comprising:

(a) face for controlling said flowing fluid, said face incorporating a hydraulic thrust surface for providing a variable opening torque, and (b) a counterweight system, comprising one or more masses, providing a variable closing torque needed to partially oppose said variable opening torque, and (c) members for rigidly connecting said face to said counterweight system and also to a pivot shaft mounted in a set of bearings, across said channel, in such a manner that said face can pivot in said channel, whereby said gate will pivot due to said variable opening torque and said variable closing torque so as to restrict said flowing fluid under said face so as to control level of said flowing fluid between a minimum and a maximum level.

9. The level controlling gate of claim 8 further including (a) endplates connected to said face piece edges, said endplates having radially shaped edges, and (b) radial jambs on said channel walls for impeding flow of said fluid around edges of said face, whereby said radially shaped edges of endplates substantially match said radial jambs.

10. The level controlling gate of claim 8 further including a viscous damping surface extending into said flowing fluid from said gate face, for reducing unwanted motion.

11. The level-controlling gate of claim 10 further including an irregularly castellated edge on the viscous damping surface, to minimize the effect of vortex formation on the operation of the gate.

12. The level controlling gate of claim 8 further including a slidably mounted pivot shaft with bearings for each end of said pivot shaft, to ease installation in said channel.

13. The level controlling gate of claim 8 further including adjustments for position of said counterweight system.

14. The level controlling gate of claim 8 wherein said face piece and said hydraulic thrust surface is a single sheet of material.

15. The level controlling gate of claim 14 wherein said single sheet incorporates an upper gate face section, which is at an angle to said hydraulic thrust surface, which is at an angle to a lower gate face section.

16. The level controlling gate of claim 15 wherein said hydraulic thrust surface produces no net buoyant upthrust under balanced head conditions.

17. The level controlling gate of claim 16 wherein said upper gate face section is an arc with a center of curvature at said pivot shaft and a predetermined radius, and said lower gate face section is an arc with a center of curvature at said pivot shaft and a radius that is a predetermined amount less than said radius of said upper gate face section.

18. The level controlling gate of claim 17 wherein said hydraulic thrust surface extends the entire width of said gate face.

* * * * *